United States Patent [19]

Francis

[11] Patent Number: 5,071,514

[45] Date of Patent: Dec. 10, 1991

[54] PAPER WEIGHT SENSOR WITH STATIONARY OPTICAL SENSORS CALIBRATED BY A SCANNING SENSOR

[75] Inventor: Kenneth E. Francis, Battleground, Wash.

[73] Assignee: Francis Systems, Inc., Vancouver, Wash.

[21] Appl. No.: 629,093

[22] Filed: Dec. 17, 1990

Related U.S. Application Data

[63] Continuation of Ser. No. 257,279, Sep. 21, 1988, abandoned.

[51] Int. Cl.[5] ..... D21F 1/06; D21F 7/00

[52] U.S. Cl. ..... 162/259; 162/263; 162/DIG. 6; 162/DIG. 11; 250/571; 356/429

[58] Field of Search ..... 162/198, 252, 253, 258, 162/259, 263, DIG. 6, DIG. 11; 250/571; 356/429; 73/159; 364/469, 471

[56] References Cited

U.S. PATENT DOCUMENTS

| | | | |
|---|---|---|---|
| 3,510,374 | 5/1970 | Walker | 162/259 |
| 3,562,500 | 2/1971 | Grant | 162/252 |
| 3,610,899 | 8/1972 | Dahlin | 162/DIG. 11 |
| 3,666,621 | 8/1972 | Adams | 162/DIG. 6 |
| 3,681,595 | 8/1972 | Dahlin | 250/83 C |
| 3,713,966 | 1/1973 | Lippke | 162/263 |
| 3,790,796 | 2/1974 | Brunton et al. | 250/339 |
| 3,936,665 | 2/1976 | Donoghue | 162/252 |
| 4,098,641 | 2/1978 | Casey et al. | 162/253 |
| 4,374,703 | 2/1983 | Lebeau et al. | 162/253 |
| 4,767,935 | 8/1988 | Anderson et al. | 356/429 |

*Primary Examiner*—Karen M. Hastings
*Attorney, Agent, or Firm*—Klarquist, Sparkman, Campbell, Leigh & Whinston

[57] ABSTRACT

A paper weight sensor system is intended for use on a paper-making machine having a headbox with a slice-lip mounted thereon for forming a moving web of material. Plural slice-lip actuators are provided for setting the slice-lip gap to control the amount of material in the web and are mounted on the headbox. Plural stationary optical sensors are located at a first station and extend across the width of the web in a continuous array for detecting the transmissivity of the web in a one-to-one relationship with the slice-lip actuators at an aligned location downstream of each actuator. Each sensor includes plural light detectors therein which are operable to generate a first transmissivity signal representing the transmissivity of the web for discrete regions thereof adjacent each light detector corresponding to a given actuator. A calibration device is provided for sensing a selected web parameter for a discrete region of the web and is operable to generate a calibration signal indicative of the selected parameter. The system includes a computer which is operable to compare each transmissivity signal and a corresponding portion of the calibration signal for a discrete region of the web and to generate a control signal which is a function of the transmissivity signal as calibrated by the calibration signal. The computer is further operable to generate related actuator signals from the control signals for adjusting each slice-lip actuator.

16 Claims, 3 Drawing Sheets

PAPER WEIGHT SENSOR WITH STATIONARY OPTICAL SENSORS CALIBRATED BY A SCANNING SENSOR

This application is a continuation of application Ser. No. 07/257,279, filed on Sept. 21, 1988 now abandoned.

BACKGROUND OF THE INVENTION

The invention relates to paper-making machines. Specifically, the instant invention includes sensors and an appertinent system for detecting and controlling the weight of paper manufactured by a paper-making machine, and a method for accomplishing the same.

Paper-making machines and quality control instrumentation therefor are well known in the art. Known quality control instrumentation generally includes some form of scanning sensor which is moved across the paper, in what is known as a cross-direction scan, to provide a value which is indicative of the bone-dry weight of the paper stock being manufactured in the paper-making machine. As the instrumentation is scanning the paper in a cross-direction, the paper is moving through the machine (machine-direction) and the net result is that the quality control instrumentation detects the weight of the paper in a zig-zag course down the length of the paper web formed in the machine.

Even where multiple scanning sensors are provided, the scanning system generally requires about ten or more cross-direction scans in order to get an accurate representation of the variation of cross-direction weight of the paper web. Additionally, the scanning sensors are typically located close to the take-up reel of the paper machine which results in a considerable time delay between the paper-forming suspension leaving the headbox, transitting the machine and arriving at the sensor. Even after the scanning sensor has been calibrated and errors corrected, there will still be a delay between the detection of an unacceptable variation in paper thickness at the sensor and the input on an appropriate control signal to the slice-lip actuators at the headbox. This delay may result in the production of an unacceptable quantity of paper which is either too light or too heavy.

An object of the invention is to provide an apparatus and method for determining short term cross-direction and machine-direction variations in a web of paper and correcting such variations.

Another object of the invention is to provide an optical measuring system which extends continuously across the width of a paper web and which will detect cross-direction and machine-direction variations in a paper web.

A further object of the invention is to provide an optical scanner which is calibrated by a scanning sensor.

Another object of the invention is to provide a system and method for making a direct measurement of fiber and water content of a paper forming web.

Yet another object of the invention is to provide relatively instantaneous control inputs to slice-lip actuators on a paper-making machine headbox.

Another object of the invention is to provide a stationary sensor which is capable of defining short term cross-direction and machine-direction variations in the paper web.

Still another object of the invention is to provide a stationary sensor which is operable to adjust a stock valve of a paper-making machine for machine direction control.

A further object of the invention is to provide means for determining and inferring a bone-dry weight of a paper weight as a function of web opacity.

The system of the invention is intended for use on a paper-making machine having a headbox therein with a slice-lip mounted thereon for forming a moving web of material. Plural slice-lip actuators for setting the slice slip gap to control the amount of material in the web are mounted on the headbox. Plural stationary optical sensors are located at a first station and extend across the width of the web in a continuous array for detecting the transmissivity of the web in a one-to-one relationship with the slice-lip actuators at an aligned location downstream of each actuator. Each sensor includes plural light detectors therein which are operable to generate a first transmissivity signal representing the transmissivity of the web for discrete regions thereof adjacent each light detector corresponding to a given actuator. A calibration device is provided for sensing a selected web parameter for a discrete region of the web and is operable to generate a calibration signal indicative of the selected parameter. The system includes a computer which is operable to compare each transmissivity signal and a corresponding portion of the calibration signal for a discrete region of the web and to generate a control signal which is a function of the transmissivity signal as calibrated by the calibration signal. The computer is further operable to generate related actuator signals from the control signals for adjusting each slice-lip actuator.

These and other objects and advantages of the invention will be more fully appreciated as the description which follows is read in conjunction with the drawings.

DETAILED DESCRIPTION OF THE EMBODIMENT

Figure 1:
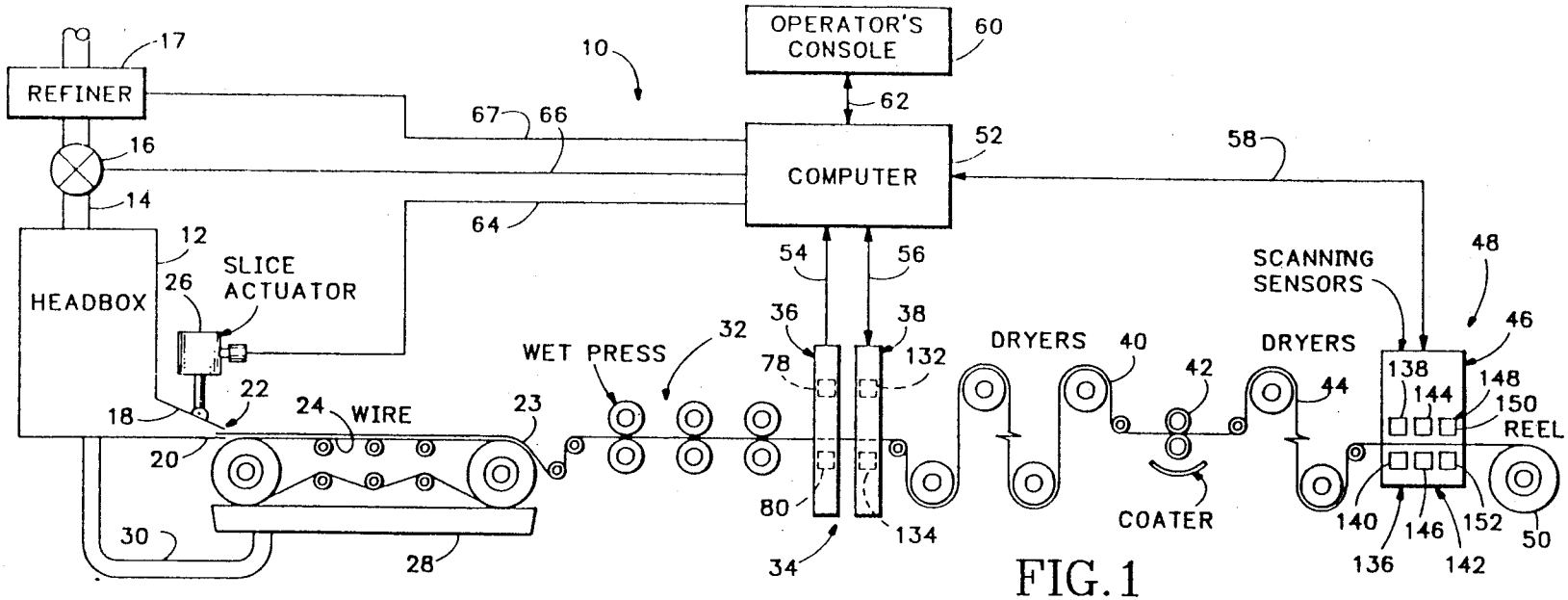
FIG. 1 is a schematic representation of a paper-making machine incorporating the invention.

Referring now to FIG. 1, a paper-making machine incorporating the control system of the invention is shown generally at 10. Machine 10 includes a headbox 12 which receives a suspension of fibers in a watery vehicle through an inlet 14. A stock valve 16 is operable to control the flow of material through inlet 14 into the headbox. A refiner 17 cuts the fibers in the suspension to a desired length.

Headbox 12 includes a slice-lip 18 which, along with a forming board 20, provides an opening, or gap, 22 through which the watery suspension of materials contained in headbox 12 passes prior to being deposited on a moving wire 24, thereby forming a paper web 23. The size of gap 22 is controlled by plural slice-lip actuators 26 which are disposed at integrals along the run of slice-lip 18. Generally, an actuator will be located every 4 to 12 inches along the run of lip 18, which, in some machines, may be as much as 400 inches.

As the web of material is transported on wire 24, excess water is drawn off of the web and is collected in a basin 28. The water collected in basin 28 is returned to headbox 12 by means of a conduit 30 Incorporated in headbox 12 is mixing apparatus (not shown) to maintain a degree of homogeneity of the material in the headbox as the water returned from basin 28 and the suspension entering the headbox through inlet 14 are combined.

The web of material exits the wire and passes through a series of wet presses 32 where it is further dried. After the web exits the web presses, it passes through a first station 34 where it is "scanned" in both machine and cross-directions for variations in web thickness. First station 34 includes a stationary optical sensor, 36, also referred to herein as plural stationary optical measurement means. Additionally, a scanning sensor 38 is located in the first station and is operable to provide calibration data which is used to calibrate stationary sensor 36. It is well known that such a scanning sensor travels continuously across the width of the web. Scanning sensor 38 may be used to measure bone-dry weight optically or it may measure the total web mass. Operation of sensors 36 and 38 will be explained in greater detail later herein.

Web 23 next passes through another set of dryers 40 and may pass through a size press or coater 42 prior to entering a final set of dryers 44. Web 23 then passes through a scanning sensor 46, located at a second station 48 prior to being wound up on a reel 50.

Data from stationary sensor 36 is transmitted to a computer 52 over a bus 54. Data from scanning sensors 38 and 46 are transmitted to computer 52 over buses 56, 58, respectively, which buses are operable to transmit control information to sensors 38, 46. An operator's console 60 communicates with computer 52 over a bus 62 and allows set values to be entered into the computer.

Figure 6:
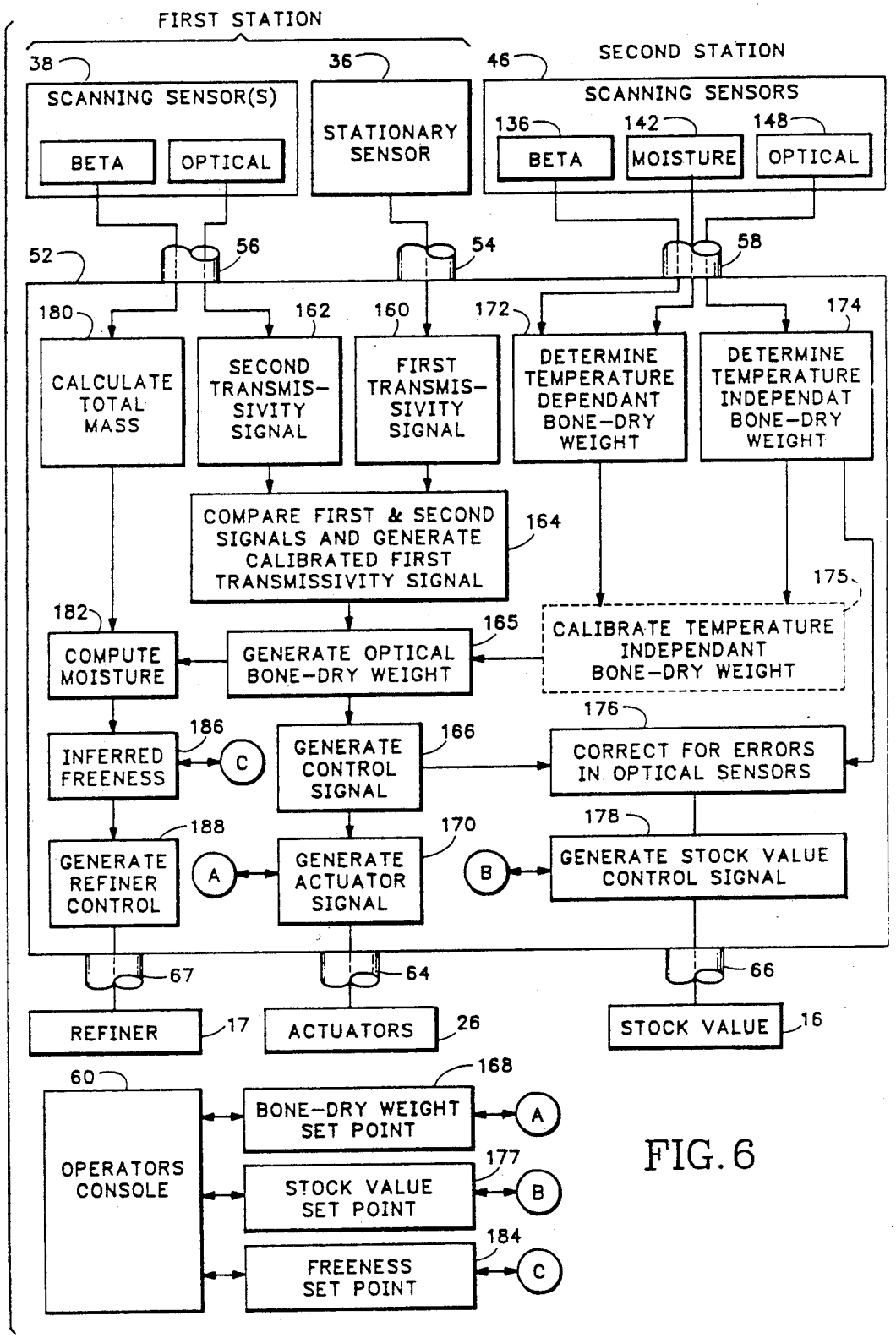
FIG. 6 is a block diagram of the control system of the paper making machine.

Referring now to FIGS. 1 and 6, computer 52, as will be described later herein, is operable to generate actuator signals which are transmitted over a bus 64 to slice-lip actuators 26. Additionally, control signals for stock valve 16 are transmitted over bus 66. Control signals for refiner 17 are transmitted over bus 67.

Figure 2:
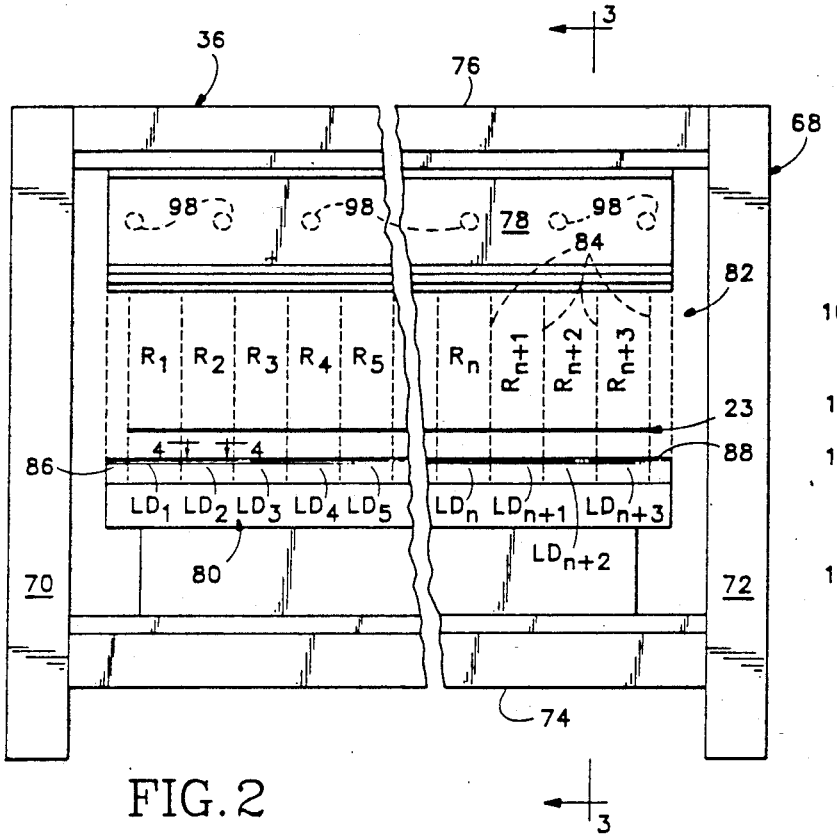
FIG. 2 is a plan view of a stationary optical sensor of the invention viewed in the machine-direction.
Figure 3:
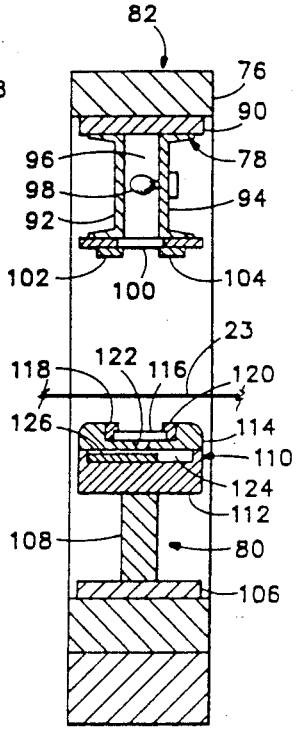
FIG. 3 is a sectional view of the sensor of FIG. 2 taken generally along the line 3—3 in FIG. 2.

Referring now to FIGS. 2 and 3, stationary sensor 36 will be described in greater detail. Sensor 36 includes a framework 68 which includes upright members 70, 72, a lower cross piece 74 and an upper cross piece 76. The framework must be sturdy enough to span a paper-making machine which may be as much as 400 inches wide and must be designed to minimize vibration, sag and deflection across its span to minimize distortions incurred due to temperature changes throughout its structure. Framework 68 provides mounting for a light source bar 78 and a light detector bar 80. Framework 68 is constructed and arranged to provide a stable platform for light source bar 78 and light detector bar 80.

Light source bar 78 and light detector bar 80 comprise what is referred to herein as optical measurement means which is generally represented by the number 82.

As described earlier, a plurality of slice-lip actuators, or slice screws, are located across the width of headbox 12 on slice-lip 18. Each actuator will affect the gap size of a portion of the slice-lip and, therefore, adjacent actuators must work in concert to avoid contorting the slice-lip into a rippled stretch which will produce a web of constantly varying thickness across the width, or cross-direction thereof. Computer 52 includes suitable programming to assure that the actuators work in such concert.

Each actuator defines a file, or actuator position, down the length of web 23 as the web is formed. These files are indicated by dashed lines 84 in FIG. 2, which are downstream, relative to web 23, from headbox 12. The actuators vary the gap size and control the amount of material exiting the headbox. The combination of the gap size and the speed with which wire 24 and the various presses and dryers move control the thickness of the material formed on the wire.

In the usual machine, actuators are spaced at 6 inch intervals across the width of the headbox. Each file is therefore approximately 6 inches wide. The files, also referred to herein as discrete regions, are represented, in FIG. 2, by the designations $R_1, R_2, \ldots R_n$, etc. For each region of the web, there is an actuator, $A_1, A_2 \ldots A_n$, etc., (not shown) and a light detector, $LD_1 \ldots LD_n$, etc.

Reference light detectors 86, 88 are positioned at either end of detector 80 to provide a reference voltage to computer 52 indicative of unimpeded transmissivity between light bar 78 and light detector 80 to enable computer 52 to correct for source/detector drift.

Referring now to FIG. 3, light source 78 includes a base 90, side members 92, 94 which form a U-shaped channel 96. Plural light sources, or bulbs, 98 are mounted in channel 96. In the preferred embodiment, light source 98 is a quartz-halogen bulb. Bulbs 98 are mounted approximately every 12 inches across the width of light source 78 and are powered by a regulated d.c. power supply. The intensity of source 78 may be varied depending on the transmissivity and weight of the paper being produced. A source filter 100 is secured to sides 92, 94 by retainers 102, 104, respectively.

Light detector 80 includes a base 106, a pedestal 108 and a sensor housing 110. Sensor housing 110 includes a light detector mount 112 and a filter carrier 114. A sensor filter 116 is received in carrier 114 and secured thereto by retainers 118, 120. A cavity 122 is formed between light detector mount 112 and filter carrier 114.

Figure 4:
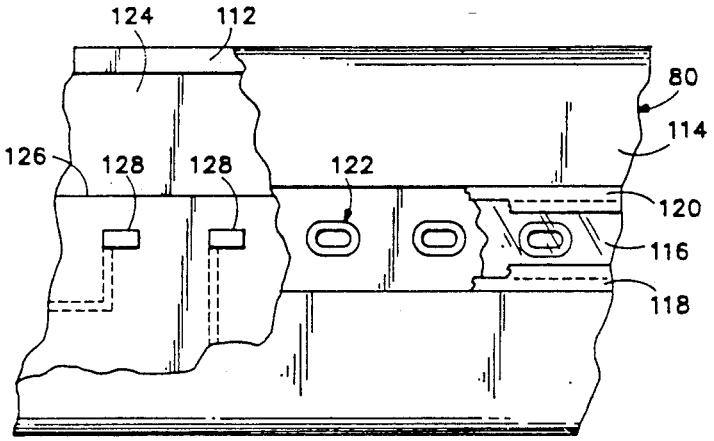
FIG. 4 is a top plan view of an optical sensor of the invention, with portions broken away to show detail.

Filter carrier 114 has a series of openings 122 formed therein and, in the preferred embodiment, are spaced at approximately 1 inch intervals along the length of the detector. Referring now to FIG. 4, a progressively broken away top view of detector bar 80 is depicted. A cavity 124 is formed between light detector mount 112 and filter carrier 114. A circuit board 126 is located in cavity 124 and carries thereon plural photo detectors 128, which may be either of the photo diode or photo transistor type. Each detector has appropriate circuitry and wiring extending therefrom through bus 54 to computer 52.

In the preferred embodiment, a group of 6 detectors form what is referred to herein as a light detector means, which are coupled, through suitable amplification electronics and computer 52 to a corresponding slice-lip actuator. Filters 100 and 116 are selected to ensure that only light originating in light bar 78 which passes through the filters and web 23 will energize the light detector means. When the light detectors means is energized by light from source 78, it generates what is referred to herein as a first transmissivity signal which is representative of the transmissivity of the web for the particular discrete region. Output from each detector may be summed to provide a signal from the detector means or, the system may be organized such that one or more detectors is a light detector means and provide a discrete input to computer 52. The transmissivity of the web is indirectly proportional to the thickness of the material in the web, which is correlated to the bone-dry weight of the web.

Figure 5:
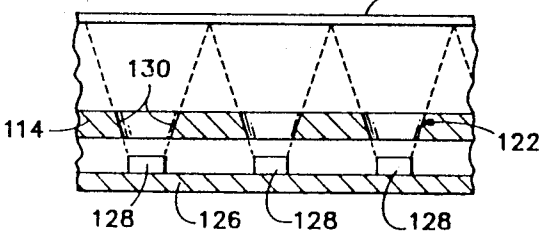
FIG. 5 is a greatly enlarged, somewhat schematic view of the optical sensor of the invention.

Openings 122 are constructed such that the light passing through an opening to the corresponding detector provides a continuous array across the width of web 23. As depicted in FIG. 5, openings 122 have a sloped side wall 130, which slope is selected to cover an area of web 23 adjacent to, but not overlapping the area covered by a detector in the adjoining region. The slope of the side wall and the interval between detectors is selected such that web 23 may be positioned within about 10% of the total distance between the light source and the detectors. This placement provides for a continuous array of detectors across the width of the web and also helps to eliminate errors induced by flutter of web 23. Were detectors 128 positioned such that web 23 were centered between light source 78 and detector bar 80, flutter in web 23 could disperse sufficient light to produce erroneous, inconsistent data. Placement of the detectors such that web 23 is located within 10% of the total distance between the source and the photo detectors will result in minimum flutter error. The distance between the light source and detectors 128 will typically be about 12 inches. In the preferred embodiment, web 23 is maintained at a distance of approximately ¾ of an inch from detectors 128.

In the preferred embodiment, openings 122 are located on 1 inch centers with sidewalls 130 sloped to direct light transmitted through web 23 to a detector having an area of approximately 0.1 square inch. Because of the small size of photo detectors 128, it is conceivable that openings 122 could be arranged in closer proximity to provide a region of as small as 0.1 inch width. This could, of course, provide sensing for discrete regions of extremely small size. For most applications, it is therefore believed that detector spacing on 1 inch centers and the appropriate spacing of openings 122 will provide more than adequate sensing of web 23 and control of machine 10.

The use of photo detectors provides for a resolution of as small as 0.1 inch across the width of the material web being formed. At best, the beta gauge provides a resolution on the order of 2 inches. The optical sensor may easily be operated at a frequency of 1 MHz while the beta gauge has a frequency on the order of 0.5 Hz, as a result of the ion chamber induced time constant.

Referring now to FIGS. 3 and 4, filters 100 and 116 may be provided for an individual application and tuned to a specific wavelength. In the preferred embodiment, a broadband filter 800–1200 nm is used at both the light bar and the detector. The use of such filters eliminates the reading of extraneous light by detectors 128. Filters of the previously mentioned wavelength are sensitive to detect the cellulose content of web 23, provided the web does not contain an excessive amount of fillers and additives, but are substantially insensitive to water remaining in the web. In the event that paper is being manufactured which contains fillers and additives, such as titanium or clay, light bar 78 and detector 128 may be removed and replaced as a unit, the replacement units having filters mounted therein to provide a sensor suitably responsive to the web and the additives therein.

Scanning sensors 38, 48, as previously mentioned, travel across the width of web 23. Additionally, they travel beyond the edges of web 23 into a reference location where the sensors mounted on the scanning carriage detect radiation which is unimpeded by web 23, thereby to obtain reference values.

In the environment of a paper-making plant, dirt build-up on the source and sensor filters will be a constant occurrence. In all probability, the dirt build-up will not be uniformly distributed across the filters and will result in readings which may indicate that the web is thicker in one region thereof then it is in another region when the thickness is, in reality, uniform. This problem may be resolved in several ways. In the case of a sheet break, when there is no obstruction between the source and detector, computer 52 may be programmed to standardize the information being received by the various detectors. Changes in the data received from reference detectors 86, 88 may be used to compensate for dirt build-up over a period of time. Additionally, some form of mechanical cleaning device may be used to periodically clean filters 100, 116. While the aforementioned methods are useful, they do not provide real time data which may be used to compensate for dirt build-up as a web is being formed on machine 10.

As previously noted, various types of scanning sensors are known in the paper-making art, however, these scanning sensors have severe short comings in that they are not able to provide continuous, cross or machine-direction data as to the thickness of the web as it is being formed. Thus, control of the slice-lip actuators may lag behind the formation of the web by as much as 30 minutes. In the case of a machine which produces in excess of 5,000 feet of paper per minute, this 30 minute lag time can result in vast quantities of paper which are unacceptable from a quality control standpoint. Control of slice-lip actuators by the stationary sensor of the invention, through computer 52, provides control based on sensing of the web within 10 to 60 seconds after the web leaves the slice-lip gap and, because the sensor extends continuously across the web, short term cross-directional control is obtained. Such control however, requires that the stationary sensor be calibrated and to that end, calibration means are provided which are operable to sense a selected web parameter for a discrete region of the web. Calibration means are operable to generate a calibration signal which is indicative of the selected parameter.

One form of calibration means is provided by scanning sensor 38, as shown in FIGS. 1 and 6. Scanning sensor 38, in the preferred embodiment, is located at the first station and includes a scanning optical measurement means for detecting transmissivity of the web, which is constructed similarly to stationary optical measurement means 82.

Scanning sensor 38, includes a light source 132 which is disposed on one side of web 23 and a light detector 134 which is located on the other side of the web. Source 132 and detector 134 are carried on a traveling mount which moves across the width of the web, maintaining source 132 and detector 134 in an aligned condition. Scanning sensor 138 is operable to generate a second transmissivity signal, which is input to computer 52 over bus 56. Computer 52 is operable to compare the first transmissivity signal 160 and the second transmissivity signal 162 and to generate therefrom a calibrated first transmissivity signal 164. An optical bone-dry weight 165 is calculated from the calibrated first transmissivity signal. A control signal 166 is generated from the optical bone-dry weight. A bone-dry weight set point 168 is input at operator's console 60 and, along with control signal 166, generates the actuator signals 170 which control actuators 26.

As sensor 38 moves to a particular region of the web, a transmissivity signal is transmitted to computer 52. The computer compares the transmissivity signal from the scanning sensor with the transmissivity signal received from the detector(s) for the particular region in the stationary sensor. The first transmissivity signals from the detectors are thus calibrated by comparison with the second transmissivity signals. It should be noted that it is the calibrated first transmissivity signals which are used to provide ultimate control for the slice-lip actuators, thereby maintaining an accurate control on the amount of material exiting gap 22.

As previously noted, scanning sensor 38 may be an optical bone dry sensor or it may be a total mass measuring sensor. If total mass is measured, moisture can be determined by subtracting the bone-dry weight from total mass. The selection of the type of sensor to use at the location of scanning sensor 38 is determined by a variety of factors, including the type of paper which will generally be produced by the machine, the weight of the paper being produced, and other factors which may be determined on a case-by-case basis. Scanning sensor 38 may, of course, include more than one sensor.

Returning now to FIG. 1, scanning sensors 46, located in second station 48 will be described in greater detail. Scanning sensor 46 may include a number of different types of sensors. However, the most common would be a beta gauge 136, also known as a nuclear measuring system (NMS), having a radiation source 138 and a radiation detector 140. A moisture sensor 142, having a transmitter 144 and a receiver 146, and a second scanning optical sensor 148, having a light source 150 and a light detector 152 may also be located at the second station.

Beta gauge 136 is operable to measure the total mass of web 23 as the web passes through the gauge. Sensor 142 is operable to measure the total moisture content of the web as it passes over the web. Moisture sensor 142 may be an infrared, microwave, R-F, dielectric or capacitance type sensor. In the preferred embodiment, an infrared sensor is used. The difference between the total mass weight and the total moisture weight provides what is known as bone-dry weight 172, which is a standard value for determining paper weight. The scanning detectors may be mounted on the same carriage, or have independent carriages, but in any event, are constructed to transit the width of the web and provide a calibration signal which is indicative of the bone-dry weight of the web for a particular region thereof.

Changes in air mass density can represent substantial errors when the sensors are used to measure lightweight papers, such as tissue. In the past it has been quite difficult to get representative short-term air column temperatures to correct the beta gauge under the circumstances where the web is moving rapidly through the sensor. The largest errors occur when the scanner transits the width of the web because the dynamics of the thermal drying of the sheet produce large temperature changes across the width. The average air gap temperature is fairly easy to monitor and compensate but may not be representative of minor changes across the width of the web.

The optical sensor is not affected by changes in air density and may therefore be used to provide an accurate, high-resolution air-density compensated total paper mass which may be used to further calibrate the bone-dry weight of the web as determined by comparing data from beta sensor 136 and moisture sensor 142, or which may be used as a stand alone measurement of a temperature-independent bone-dry weight.

The second scanning optical sensor 148 may provide an indication of web transmissivity at the second station which may be compared with the bone-dry weight as determined from the beta gauge and the infrared sensor, thereby providing an inferred, temperature-independent bone-dry weight 174 from the web transmissivity. Data from the scanning sensors at the second station may be correlated on a region-by-region basis with the transmissivity of stationary sensor 36 to calculate an inferred bone-dry weight from the transmissivity signal and generated at the location of the first station, which may be used to control slice-lip actuators 26.

Beta sensor 136 and moisture sensor 142 may be used to calculate long-term, temperature dependent bone-dry weight 172 and this value may be used to calibrate the short term, temperature-independent bone-dry weight 174. The optical bone-dry weight 165 may be calibrated with bone-dry weight data 175 from the second station sensors.

The optical sensors are generally not subject to the disadvantages of the beta sensors in that the optical sensors are unaffected by air column density or temperature. Additionally, the electronics are quite simple enabling relatively inexpensive redundancy of sensors. The optical sensor does not utilize radioactive particle emission as does the beta sensor. This is a safety advantage in favor of the optical sensor. It is foreseeable that the optical sensor could, at some point in the future, replace the beta sensor thereby eliminating the use of radioactive material in a working environment.

The short term accuracy of the optical sensors which are used to determine bone-dry weight is better than the short term accuracy of data gathered by the beta and infrared sensors because the beta sensor is sensitive to air density variations, which may also be thought of as temperature variations, in the air gap between the radiation source and the radiation detector. The optical bone-dry weight sensor and the infrared moisture sensors are not sensitive to air density variations in the air gap and may therefore be used to more accurately compute total mass from the optical bone-dry weight sensor and the moisture sensor by the following:

$$\text{Total mass} = \frac{\text{bone-dry weight}}{1} - \text{moisture}$$

Thus it is possible to calculate a temperature independent total weight of the web with high short term accuracy by comparing the bone-dry weight gathered by the optical sensor and the moisture as gathered by the moisture sensor. The total mass so calculated may be further calibrated by comparison with the total mass as measured by the beta sensor in the long term.

Additionally, once the bone-dry weight 174 has been determined as a result of measurements at the second station, the data may be used to correct 176 any errors in the optical sensors at the first station. Such corrections may account for dirt build-up on the sensors, drift in the sensor circuitries or detectors, etc. Control signal 166 may be modified by temperature-independent bone-dry weight 174. Once such corrections have been been made, the operator may input a stock valve set point 177 and computer 52 may be used to generate a machine-direction stock valve control signal 178 which is transmitted to stock valve 16 to control the machine-direction thickness of the web.

As the beta gauge is a scanning sensor, it is slower to detect changes in cross-direction paper weight along a particular portion of the web, as indicated by the amount of radiation absorption of the paper at any particular point. The beta gauge does, however, offer a good long-term measurement characteristics and is not affected by certain paper additives. It is currently accepted as the best means of measuring variations in machine and cross-directions of a paper web. The disadvantages of the beta sensor that it offers poor frequency response for short-term measurement, has a high source noise and utilizes complex electronics. It is also susceptible variations in air gap density and will suffer drift problems due to minor changes in environment. A beta gauge contains radioactive material and is therefor subject to regulations and presents somewhat of a health hazard.

Likewise, IR sensor 142 is also slower to detect changes in a particular portion of the web. Sensors 36, 38 and 148, on the other hand, respond nearly instantaneously to variations in paper weight. By utilizing a beta gauge together with the optical sensors, the beta gauge will be able to dynamically correct the optical sensor in long term measurements while allowing the transmissivity signals from the optical sensor to direct operation of the slice-lip actuators, thereby making corrections in the thickness of material deposited on wire 24 in, at most, a few minutes of the time when an undesirable variation in the paper web is produced.

A paper-making machine nominally set to produce twenty-pound paper will produce the paper at the rate of approximately 1,000 feet per minute, although rates of up to 5,000 feet per minute occur in some instances. Scanning sensors 38, 46 will scan the sheet once every minute and will require about 10 scans across the sheet to determine cross-direction variants. Additionally, there is a transport delay between headbox 12 and take-up reel 50 of about 2 minutes. A transport lag is thus defined as 10 minutes (10 scans) plus 2 minutes (transport delay). Approximately 3 transport lags are required before the machine can correct an error using only scanning sensors. Thus a time delay of 36 minutes occurs between the detection of an error and the correction thereof. With conventional scanning sensor technology, some 36,000 feet of paper may run through the machine before the measurements are properly integrated and producing accurate control signals for the slice-lip actuators.

Sensor 36, on the other hand, provides an input to computer 52, which require approximately 1 second to integrate. In the case of sensor 36, the transport delay from the headbox to the sensor is approximately 10 seconds. The transport lag is therefore 1 second (electronic time constant tuned to minimum integration required for useful information) plus 10 seconds (transport delay) times 3 (number of transport delays to make adjustment) which equals 33 seconds or 0.55 minutes. The amount of paper which will run through the machine before the sensors produce accurate control signals is approximately 550 feet.

Because of the electronic characteristics of photo detectors 128, it is possible to make continuous, discrete measurements of transmissivity in the machine-direction as the detectors may be set to sample at virtually any speed. However, sampling may generally be set to take place at a rate of 1 MHz with computer 52 providing a mean value which will ultimately be used as the source input for calculating the actuator signal.

Figure 7:
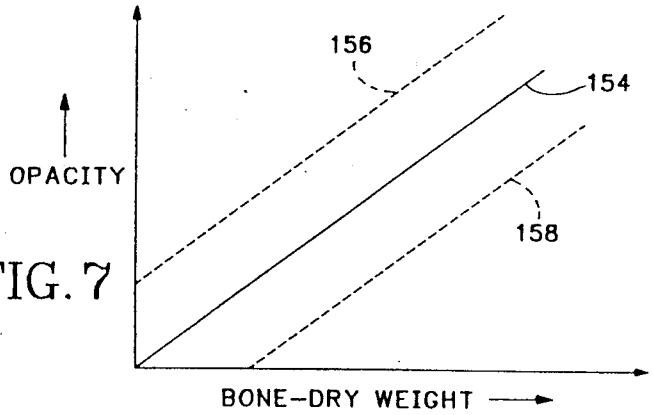
FIG. 7 is a graph comparing opacity to bone-dry weight.

Referring now to FIG. 7, a graph depicting the opacity (which is inversely related to the transmissivity) is depicted as it related to the bone-dry weight of a paper product. The ideal relationship is depicted by line 154 while the limits of drift are depicted at 156, 158. If the ideal value, or slope, for line 154 is input to computer 52 by an operator as a set value, the opacity or transmissivity may be compared to the ideal and be allowed to operate within the range established by lines 156, 158. So long as the slope of the ideal value does not change, stationary 36 and scanning sensor 38 will be operable to maintain adequate cross and machine-direction control. The actual value for the slope of line 154 may be computed by determining the bone-dry weight by the technique previously discussed in connection with the beta gauge and infrared moisture gauge.

A further modification of the system includes the provision of a scanning beta sensor located at the first station. With this arrangement, the optical bone-dry weight 165, as determined by stationary optical sensor 36 is compared with the total web mass 180, as measured by the beta sensor at the first station and the moisture computed 182 at the wet end of the paper-making machine. The operator may input a freeness set point 184 to optimize freeness control with console 60 which is combined with the computed moisture 182 to provide a freeness control signal 186 which may be used to generate a refiner control signal 188, to control refiner 17. Freeness is a value that indicates how fast water will drain through the web. The refiners are operable to control the size of the fibers which are going into the headbox. When fibers are cut extremely fine by the refiner, they provide a stronger, less free web which does not readily permit water to drain through the web. By locating the scanning beta sensor at the first station, short term control may be achieved. Resolution of better than 0.1% may be obtained with this system. There is a direct correlation between mechanical water removal (in the wet presses 32) and the freeness of the paper. Inferred freeness may be measured by monitoring small changes in the moisture level of the web as it leaves the wet presses. Automatic control of the refining process may be accomplished with the use of computer 52 and the inferred freeness value. Measuring moisture at this location will also provide improved control of the thermal dryers 40, which in turn results in better control of the moisture content as the web leaves the dryer.

It should be appreciated that all or some of the sensors described may be used in the system. The basic system includes the stationary optical sensor and a means of calibrating that sensor. Additional refinements are possible through the provision of more sensors.

The invention is not restricted to the particular embodiments which have been described, since variations may be made therein without departing from the scope of the invention as defined in the appendent claims.

It is claimed and desired to secure by Letters Patent:

1. A control system for making paper comprising:

a paper-making machine having a headbox therein with a vertically adjustable slice-lip mounted thereon for forming a moving web of material;

plural slice-lip actuators for setting a slice-lip gap to control the amount of material in the web, each slice-lip actuator structured to set a gap in a separate portion of the slice-lip to control the amount of material in a discrete region of the web;

plural stationary optical measurement means extending across the width of the web in a continuous array for detecting the transmissivity of the web in a one-to-one relationship with said slice-lip actuators at an aligned location downstream of each actuator, each measurement means structured to generate a fist transmissivity signal representative of the transmissivity of the web for a discrete web region corresponding to a given actuator;

a scanning calibration sensor constructed and arranged for movement across the width of the web for sensing a selected web parameter and structured to generate plural second signals indicative of the selective parameter, one second signal for each of the web regions sensed by said optical measurement means; and logic means structured to compare the transmissivity signal for each discrete region of the web to the second signal for the same region of the web, and to generate a control signal for each slice-lip actuator as a function of the transmissivity signal as calibrated by the second signal for a discrete region of the web, said logic means being further structured to compare the control signal to a set point signal for generating an actuator signal for adjusting the slice-lip actuator.

2. The system of claim 1 wherein said optical measurement means includes a light source disposed on one side of the web and a light detector disposed on the other side of the web.

3. The system of claim 2 wherein said plural stationary optical measurement means are contained in a stationary sensor which further includes a reference sensor for unobstructed sensing of said light source when the web is in place between said plural stationary optical measurement means and said light source.

4. The system of claim 1 wherein said scanning calibration sensor is constructed and arranged for continuous movement across the width of the web.

5. The system of claim 1 wherein said scanning calibration sensor includes scanning optical measurement means for detecting transmissivity of the web, the measurement means including a light source disposed on one side of the web and an aligned light detector disposed on the other side of the web for generating a second transmissivity signal.

6. The system of claim 5 wherein said logic means is structured to compare the first transmissivity signal and the second transmissivity signal and to generate a calibrated first transmissivity signal therefrom as the control signal.

7. The system of claim 1 including a second scanning sensor for sensing parameters indicative of total web mass and total web moisture.

8. The system of claim 7 wherein said second scanning sensor includes a beta gauge for sensing total web mass and a moisture sensor for sensing total web moisture.

9. The system of claim 7 wherein said logic means is responsive to the second scanning sensor for determining a bone-dry weight value for the web.

10. The system of claim 1 wherein said scanning calibration sensor includes a temperature-independent detector for sensing parameters indicative of total web mass and total web moisture.

11. The system of claim 10 wherein the scanning calibration includes a scanning optical sensor for sensing web bone-dry weight, a moisture sensor for sensing total web moisture, and a beta gauge for sensing long-term total web mass.

12. The system of claim 11 wherein said logic means includes means for calibrating the web bone-dry weight from the long-term total web mass, and wherein said calibration signal is indicative of web bone-dry weight as determined from the calibrated bone-dry weight, and wherein said actuator control signal is indicative of an inferred bone-dry weight as determined by said stationary optical measurement means.

13. The system of claim 1 which further includes a stock valve for controlling the flow of material into the headbox and wherein said logic means includes means therein for controlling said stock valve.

14. The system of claim 13 wherein said stock valve control means includes means for correcting errors in said control signals and to generate a stock valve control signal therefrom.

15. The system of claim 1 wherein said logic means is structured to generate an optical bone-dry weight signal from said transmissivity signals, and which includes a refiner located upstream of the headbox and a scanning beta gauge at said first station, said scanning beta gauge being operable to generate a web total-mass signal, said logic means being further structured to generate a total moisture signal, indicative of the total moisture of the web at the location of the first station, from said optical bone-dry weight signal and said total web-mass signal, said logic means being further structured to generate a refiner control signal from said total-moisture signal.

16. A control system in a paper-making machine having a headbox with a slice-lip mounted thereon for forming a moving web of material comprising:

a plurality of slice-lip actuators for setting a slice-lip gap to thereby control the amount of material in the web, each slice-up actuator structured to set a gap in a separate portion of the slice-lip to control the amount of material in discrete region of the web;

a plurality of stationary optical measurement means arrayed across the width of the web in a one-to-one relationship with the slice-lip actuators for producing a plurality of first signals indicative of the transmissivity of the web measured at locations across the width of the web in machine-direction alignment with a slice-lip actuator;

a scanning optical measurement means for producing a plurality of second signals indicative of the transmissivity of the web measured at locations across the width of the web in machine-direction alignment with a slice-lip actuator and stationary optical measurement means, said scanning optical measurement means comprising a light source and a light detector disposed in an aligned condition an opposite sides of the web and mounted for cross-direction movement across the web; and logic means interconnected with said slice-lip actuators, said plural stationary optical measurement means, and said scanning optical measurement means and structured for comparing said first and second signals measured at a location aligned with a respective slice-lip actuator, for producing a calibrated transmissivity signal as a control signal for a region of the web, and for structured for comparing the control signal to a set point signal for generating an actuator signal for adjusting said slice-lip actuator.

* * * * *

UNITED STATES PATENT AND TRADEMARK OFFICE

CERTIFICATE OF CORRECTION

PATENT NO. : 5,071,514

DATED : December 10, 1991

INVENTOR(S) : Kenneth E. Frances

It is certified that error appears in the above-identified patent and that said Letters Patent is hereby corrected as shown below:

Column 11, line 9, "fist" should be --first--.

Signed and Sealed this

Fifteenth Day of June, 1993

Attest:

Michael K. Kirk

MICHAEL K. KIRK

Attesting Officer

Acting Commissioner of Patents and Trademarks